United States Patent [19]

Blanchard et al.

[11] 3,934,971

[45] Jan. 27, 1976

[54] PROCESS FOR PREPARING MULTICOLORED COTTON PILE FABRIC

[75] Inventors: Eugene J. Blanchard, New Orleans; Gloria A. Gautreaux; Robert J. Harper, Jr., both of Metairie, all of La.

[73] Assignee: The United States of America as represented by the Secretary of Agriculture, Washington, D.C.

[22] Filed: June 4, 1974

[21] Appl. No.: 476,244

[52] U.S. Cl. ..... 8/14; 8/18

[51] Int. Cl.[2] ..... D06P 1/00; D06P 5/12

[58] Field of Search ..... 8/14, 18

[56] References Cited

UNITED STATES PATENTS

| | | | |
|---|---|---|---|
| 1,376,569 | 5/1921 | Noll | 8/14 |
| 1,649,710 | 11/1927 | Leemann et al. | 8/66 |
| 2,319,073 | 5/1943 | McElhaney | 8/21 B |
| 2,475,672 | 7/1949 | Mellor et al. | 8/15 |
| 2,762,719 | 9/1956 | Kleiner et al. | 8/18 |
| 3,046,075 | 7/1962 | Kantner et al. | 8/17 |
| 3,468,694 | 9/1969 | Moritz et al. | 8/15 |
| 3,847,542 | 11/1974 | Harper et al. | 8/17 |

*Primary Examiner*—Ronald W. Griffin

*Attorney, Agent, or Firm*—M. Howard Silverstein; Max D. Hensley

[57] ABSTRACT

This invention relates to a process for producing bicolored and tricolored cotton toweling by means of selective dyeing procedures. In this method, initial surface dyeing is followed by overdyeing of the entire fabric.

5 Claims, No Drawings

PROCESS FOR PREPARING MULTICOLORED COTTON PILE FABRIC

A non-exclusive, irrevocable, royalty-free license in the invention described, throughout the world for all purposes of the United States Government, with the power to grant sublicenses for such purposes, is hereby granted to the Government of the United States of America.

The invention relates to the dyeing of cotton and other cellulosic containing fabrics in such a manner as to produce bicolored and tricolored fabrics. The bicolored effect is achieved by a surface dyeing of the fabric followed by overdying of the entire fabric. The unique character of this procedure stems from two elements. First, because a cotton pile fabric is utilized, the top of the loops is dyed one color while the base of the loops is a second color. This technique would not yield the same color effects on the usual woven fabrics. The second element in this procedure is the use of color increments in the initial and second dyeings. By this is meant that one color component is added in surface dyeing while the second component is added in the second dyeing. For example, green is a combination of yellow and blue. If one uses a blue dye in the initial coat and overdyes the entire fabric yellow then the resultant fabric will be green on the coated side with the base of the towel loop being yellow. The reverse side of the fabric is likewise yellow. If in the coating operation, the desired green shade had been applied, the resulting color after overdyeing would have been a dark green yellow. This indicates the need for using the components for a particular color in both the coating and overdyeing operation if one is to achieve the brightness and contrast of color desired.

In another example of the same operation, the initial surface coating was done using red. The subsequent overdyeing was done in yellow. The result was a fabric with orange loops with a yellow background on one side with the other side being dyed yellow.

Because many dye shades are combinations of several dye colors, it can be seen that the components in these combinations can be used in coating and overdying to produce numerous color effects. For example, a particular shade of deep green can be produced using a dye bath containing 3.00 oz/gallon of Reactive Yellow, 4.10 oz/gallon of Reactive Blue and 0.50 oz/gallon of Reactive Orange. If the surface coating is applied to contain all the blue and orange and the fabric is overdyed with a bath containing yellow only, the result is a fabric that is the desired green in the loops on one side with the base of the loops yellow and the reverse side of the fabric being yellow. Conversely, if the surface coating is done in such a way that it contains all the orange and yellow then the entire fabric is overdyed with the blue, the loop surface on the coated side is the deep green shade. However, the base of the loops is blue and the reverse side of the fabric is blue. Other examples can readily be devised and will be given subsequently. The method is particularly effective if one wants to produce a dark loop with a light or pastel background with the reverse side of the fabric being pastel.

Extensions of the standard method can be used to produce other effects. For example, instead of the entire surface loop area on one side of the fabric being coated, the coating with dyestuff can be done in the form of prints or designs. If this is done in blue, for example, and the entire fabric is overdyed in yellow, then a green print with a yellow background in the nonprinted areas is produced. With printing, more than one color can be used with the recognition that the overdyeing will modify the printed color. For example, a dye print is made on a towel using red, blue and equal amounts of red and blue. When this is overdyed with the yellow, the result is a green, orange and black print with a yellow background. If lesser amounts of yellow are used in overdyeing, the green in the print becomes more blueish, the orange more reddish and the black more of a purple. With prints of many colors it can be seen that here it is more advantageous to use lighter, more pastel shades in overdyeing.

In another variation of the standard method, the coating operation can be performed on both sides of the fabric. For example, if fabric is coated on both sides with red and then overdyed with yellow, the result is a fabric with an orange on the top of the pile with a yellow background on both sides of the fabric. In another variation of this, a tricolored effect can be produced. For example, one side of the fabric can be coated with a red and the other side coated with a blue. If one stops at this point, there is produced a red surface pile with a white background on one side and blue surface pile with a white background on the second side. However, if one now dyes this red and blue fabric with a yellow reactive dye, the result is a fabric with green pile loops and yellow background on one side of the fabric while the other side has orange loops with a yellow background. Thus it can be seen that by this method a tricolored effect on fabric can be produced.

Several comments might be made relative to the fabrics prepared in this manner. Because a given pile yarn dyed by the process of the invention is one color in one segment and a second color in another segment, fabrics such as prepared by this method cannot be duplicated by using dyed yarns in weaving. Second, because the method utilizes a cotton reactive group and a water soluble thickener, the absorbency of the toweling is not affected by this operation. By contrast, many printing operations on toweling leave the fabric non-absorbent because insoluble polymers have been used in printing operations to restrict the position of the dye on the fabric. In this procedure the position of the dye has been achieved by means of a chemical reaction of the dye with cotton.

At this point the specific experimental procedure will be illustrated. Initially the toweling is padded to 90% wet pickup with a catalyst formulation containing 1% sodium hydroxide, 5% sodium carbonate and 8% sodium sulfate. The fabric is dried for 10 minutes at 60°C. Then the fabric is coated with a formulation containing 0.1 – 1.0% reactive dye and 2% sodium alginate. The fabric is dried for 7 minutes at 60°C. For better dye coverage a second coat can be given if it is desired to cut down on the grin-through of the color of the ground of the fabric. Thus the second coat utilizes the same formulation as in the initial coat. However, it is desirable that the direction of application of the coat is opposite to the initial coat. For example, this means that if the initial coat is performed on small equipment and the coating blade moves from right to left on the fabric, in the second coat, the blade is moved from left to right. With large equipment the fabric is moved past the coating bar and the fabric is coated in one direction on the initial pass and the reverse direction on the subsequent pass. By this means, both sides of a loop of the pile can be coated. Following the coating the fabric is dried for 10 minutes at 65°C and cured for 5 minutes at 100°C. This fabric is then washed, soured with 1% acetic acid, rinsed and redried. The fabric is next given the second dyeing (overdying) using a standard method normally employed with a reactive cotton dye.

The preceding is the standard method employed for producing the bicolored towels. The other variations described for producing tricolored or printed towels can be done with relatively simple variations of the standard method. For tricolored or for towels bicolored on both sides, it is only necessary to perform the previously described coating operations on both sides of the fabric. If the same color dye is used in coating on both sides, a towel that is bicolored on both sides is ultimately obtained. If different colored dyes are used on each side of the fabric in coating, a tricolored fabric is ultimately obtained.

Similarly, in the printing operation the fabric is padded with the catalyst, then the dye and the thickener is printed on the fabric in the proper locations. In all cases, the procedure for the final dyeing (overdying) is a standard cotton dyeing process.

The preceding is the general procedure of this process. Concentrations of catalyst, dye and thickener as well as dyeing conditions, drying conditions and curing conditions can be modified considerably by one skilled in the art to control depth and penetration of color. While this procedure has been given using reactive dyes only, the method is readily amenable to other dye systems using different types of cotton dyes.

The following examples may be viewed as illustrative of the methods utilized in this process. Variations and extensions of these procedures can be employed readily by anyone skilled in the art. Particularly, it should be noted that printing can be done on both sides of the fabric and a variety of colors can be used in printing.

EXAMPLE 1

A desized, scoured and bleached sample of white cotton terry toweling was padded to approximately 90% pickup with a formulation containing 1% sodium hydroxide, 5% sodium carbonate, 8% sodium sulfate and 86% water.

The fabric was dried for 10 minutes at 60°C. Then, a coating mixture was applied to one side of the fabric. The coating formulation contained 2 % sodium alginate, 0.17% Reactive Blue 41, 0.04% Reactive Orange 4, 0.079% Reactive Brown 10 and 97% water. The fabric was dried for 10 minutes at 60°C, then the formulation was used to coat the same side of the fabric in the reverse direction. The fabric was redried for 10 minutes at 60°C and cured for 5 minutes at 100°C. This fabric was then rinsed, soured in a solution containing 1% glacial acetic acid and 99% water and again dried.

Then the fabric was dyed with Reactive Red 5 using a standard dye procedure. Essentially this consisted of inserting, at room temperature, the fabric into an aqueous bath containing 0.1% dye (based on the weight of water) and 40% sodium sulfate (based on the weight of fabric). For each gram of fabric, 30 grams of the bath solution were employed. The samples were stirred for 15 minutes, removed from the dye bath, 30% sodium carbonate (based on weight of fabric) was added, the solution warmed to 60°C and kept between 55°-60°C for the remainder of the dyeing operation. The fabric sample was reinserted in the dyebath and the bath was stirred for 15 minutes. The fabric was rinsed in cold water and then heated in a hot bath containing a wetting agent. The sample was then laundered.

The result was a fabric with purple loops and a pink ground on one side with the reverse side of the fabric being pink.

EXAMPLE 2

A white cotton terry towel was finished using the same procedure as in Example 1 except that in the coating operation the formulation was prepared using 2% sodium alginate, 0.7% Reactive Orange 4, 0.3% Reactive Brown 10 and 97% water. In the overdying step, 1% dye was used based on the weight of water. This 1% dye consisted of 0.08% Reactive Yellow 22 and 0.92% Reactive Blue 3. When the procedure was concluded, there was produced a cotton terry toweling which had rusty (brown) loops with a turquoise base (ground) on one side with the reverse side of the fabric being turquoise.

EXAMPLE 3

A desized, scoured and bleached white cotton terry towel was finished using the same procedure as in Example 1. However, the coating formulation contained 2% sodium alginate, 1% Reactive Blue 5 and 97% water. In the second dyeing, 1% dye (Reactive Yellow 22) based on the weight of the water was used. There was obtained a fabric which had green loops with a yellow ground on one side with the reverse side of the fabric being yellow.

EXAMPLE 4

A desized, scoured and bleached white cotton terry toweling was finished using the same procedure as in Example 1. However, the coating formulation contained 2% sodium alginate, 1% Reactive Red 5 and 97% water. In the second dyeing, 1% dye (Reactive Yellow 22) was used based on the weight of the water. There was obtained a fabric which had orange loops with a yellow background on one side with the reverse side of the fabric being yellow.

EXAMPLE 5

A desized, scoured and bleached white cotton terry towel was finished using the same procedure as employed in Example 1. However, the coating formulation contained 2% sodium alginate, 0.56% Reactive Brown 10, 0.10% Reactive Blue 41, 0.34% Reactive Yellow 22 and 97% water. In the second dyeing, the procedure was the same as in Example 1 except that 1% dye was used based on the weight of the water. This 1% dye was composed of 0.975% Reactive Yellow 22 and 0.025% Reactive Orange 4. There was obtained a fabric with brown loops and a yellow ground on one side with the reverse side of the fabric being yellow.

EXAMPLE 6

A desized, scoured and bleached sample of a white cotton terry toweling was padded to approximately 90% wet pickup with a formulation containing 1% sodium hydroxide, 5% sodium carbonate, 8% sodium sulfate and 86% water. The fabric was dried for 10 minutes at 60°C. Then a coating mixture was applied to one side of the fabric. The coating formulation contained 2% sodium alginate, 1% Reactive Blue 3 and 97% water. The fabric was dried for 10 minutes at 60°C. Then the same formulation was used to coat the same side of the fabric in the reverse direction. The fabric was redried for 10 minutes at 60°C. Then the back side of the fabric was coated twice in the same manner as the front side of the fabric. The fabric was redried for 10 minutes at 60°C and cured for 5 minutes at 100°C. This fabric was rinsed, scoured in a solution containing 1% glacial acetic acid and 99% water. The fabric was again dried.

Then the fabric was dyed with 1% Reactive Yellow 22 using a standard dye procedure as described in Example 1. There was obtained a fabric which was bicolored on both sides. On each side the loops of the fabric pile were dyed green while the ground of the fabric was dyed yellow.

EXAMPLE 7

A desized, scoured and bleached white cotton terry towel was finished in a manner similar to that employed in Example 6. However, in the coating operation the formulation contained 2% sodium alginate, 1% Reactive Red 5 and 97% water. In the overdyeing procedure the dye employed was 1% Reactive Yellow 22 based on the weight of the water. The finished towel was bicolored on both sides. The fabric had orange loops and a yellow ground.

EXAMPLE 8

A desized, scoured and bleached white cotton terry towel was dyed in a manner similar to that employed in Example 6. However, the coating formulation was composed of 2% sodium alginate, 0.56% Reactive Brown 10, 0.10% Reactive Blue 41, 0.34% Reactive Yellow 22 and 97% water. In the overdyeing procedure, 1% dye (composed of 0.975% Reactive Yellow 22 and 0.025% Reactive Orange 4) was used based on the weight of the water. There was obtained a fabric with brown loops and a yellow ground on both sides.

EXAMPLE 9

A desized, scoured and bleached sample of a white cotton terry toweling was padded to approximately 90% wet pickup with a formulation containing 1% sodium hydroxide, 5% sodium carbonate, 8% sodium sulfate and 86% water. The fabric was dried for 10 minutes at 60°C. Then a coating mixture was applied to one side of the fabric. The coating formulation contained 2% sodium alginate, 1% Reactive Blue 3 and 97% water. The fabric was dried for 10 minutes at 60°C. Then the same formulation was used to coat the same side of the fabric in the reverse direction. The fabric was redried for 10 minutes at 60°C. Then the back side of the fabric was coated twice in the same manner as the front side of the fabric with a different coating formulation. This coating formulation consisted of 2% sodium alginate, 1% Reactive Red 5 and 97% water. The fabric was redried at 60°C for 10 minutes and cured for 5 minutes at 120°C. The fabric was rinsed, soured in a solution containing 1% acetic acid and 99% water, then redried. The result was a tricolored fabric in which the loops of the fabric were blue with a white ground on one side with the reverse side of the fabric having red loops with a white ground.

EXAMPLE 10

The fabric from Example 9 was overdyed with 1% Reactive Yellow 22 using the same procedure as employed in overydyeing in Examples 1 and 3. The result was a tricolored fabric in which one side had green loops with a yellow background with the reverse side of the fabric possessing orange loops with a yellow background.

EXAMPLE 11

A desized scoured and bleached white cotton terry toweling was finished as in Example 9 with the following exceptions. In the first coating operation, the composition of coating mixture was 2% sodium alginate, 1% Reactive Red 5 and 97% water. In coating the second side of the fabric, a coating formulation consisting of 2% sodium alginate, 1% Reactive Yellow 22 and 97% water was used. The result was a tricolored fabric in which the loops of one side of the fabric were red with a white ground while on the reverse side of the fabric the loops were yellow with a white ground.

EXAMPLE 12

The fabric from Example 11 was dyed with 1% Reactive Blue 3 using the same procedure as employed in overdyeing in Examples 1 and 3. The result was a tricolored fabric in which one side of the fabric had green loops with a blue background while the reverse side of the fabric had purple loops with a blue background.

EXAMPLE 13

A desized, scoured and bleached white cotton terry toweling was dyed as the towel in Example 9 with the following exceptions. In the first coating the composition of the coating mixture was 2% sodium alginate, 1% Reactive Orange 4 and 97% water. In coating the second side of the fabric, a coating formulation consisting of 2% sodium alginate, 1% Reactive Brown 10 and 97% water was used. The result was a tricolored fabric in which the loops on one side of the fabric were orange with a white background while on the reverse side of the fabric the loops were brown with a white ground.

EXAMPLE 14

A desized, scoured and bleached sample of white cotton terry toweling was padded to approximately 90% wet pickup with a formulation containing 1% sodium hydroxide, 5% sodium carbonate, 8% sodium sulfate and 86% water. The fabric was dried for 10 minutes at 60°C. Then a coating mixture was applied to one side of the fabric. The coating formulation contained 1% Reactive Blue 41, 2% sodium alginate and 97% water. The fabric was dried for 10 minutes at 60°C. Then the same formulation was used to coat the same side of the fabric in the reverse direction. The fabric was redried for 10 minutes at 60°C. Then the back side of the fabric was coated twice in a similar manner as the front side of the fabric with a different coating formulation. This coating formulation consisted of 2% sodium alginate, 0.9% Reactive Yellow 22, 0.009% Reactive Orange 4, 0.091% Reactive Blue 41 and 97% water. The fabric was redried at 60°C for 10 minutes and cured for 5 minutes at 120°C. The fabric was rinsed, scoured in a solution containing 1% acetic acid and 99% water, then redried. This fabric was then overdyed with 0.08% Reactive Red 5 using the same procedure as employed for immersion dyeing in Example 1. The result is a tricolored fabric in which the fabric had blue loops with a pink ground on one side and lime loops with a pink ground on the reverse side.

EXAMPLE 15

A desized, scoured and bleached sample of white cotton terry toweling was finished as in Example 1 with the following exceptions. In the coating operation, instead of coating the entire side of the fabric, the coating formulation was laid down in the form of one-half inch stripes with one inch stripes of uncoated fabric intervening. The result after completion of all dyeing was a striped fabric with one-half inch stripes with purple loops and a pink ground with one inch stripes of all pink fabric on one side with the reverse side of the fabraic being entirely pink.

EXAMPLE 16

A desized, scoured and bleached sample of white cotton terry toweling was finished as in Example 2 with the following exceptions. In the coating operations, instead of coating the entire side of the fabric, the coating formulation was laid down in a checkered pattern of 1½ inch squares; that is, every other square in each direction was coated. The result after completion of all dyeing was a checkered fabric in which multicolored brown and turquoise squares alternated with turquoise squares on one side with the reverse side of the fabric being turquoise. The multicolored squares had brown loops with a turquoise background.

EXAMPLE 17

A desized, scoured and bleached sample of white cotton terry toweling was finished as in Example 4 with the following exceptions. In the coating operations, instead of coating the entire side of the fabric, the coating formulations were laid down in the form of one inch circles with one inch between circles in both the length and width of the fabric.

The result after completion of all dyeing was a fabric with multicolored circles in each direction and a yellow fabric in the uncoated areas. The reverse side of the fabric was also yellow. The multicolored circles had orange loops with a yellow ground.

EXAMPLE 18

A desized scoured and bleached sample of white cotton terry toweling was finished as in Example 5 with the following exceptions. In the coating operations, instead of coating the entire side of the fabric, the coating formulations were laid down in the form of 1 inch squares with 1 inch between squares in both the length and width of the fabric.

The result after completion of all dyeing was a fabric with multicolored squares in each direction with the remainder of the fabric being yellow in the uncoated areas. The reverse of the fabric was also yellow. The multicolored squares had brown loops with a yellow ground.

We claim:

1. A process for producing cotton pile fabrics which are multicolored on one side which process comprises:

a. padding the fabric with a basic catalyst solution,
b. drying the fabric from a,
c. coating the loops on one side of the cotton pile fabric from b with a formulation containing a reactive dye and thickening agent,
d. drying and subsequently curing the fabric from c,
e. washing the cured fabric from d,
f. overdyeing the washed fabric from e with a second reactive dye.

2. The process of claim 1 wherein the coating of step c is in the form of stripes or checks.

3. A process for producing cotton pile fabrics, which are multicolored on both sides, which process comprises:

a. padding the fabric with a basic catalyst solution,
b. drying the fabric from a,
c. coating the loops on one side of the cotton pile fabric from b with a formulation containing a first reactive dye and a thickening agent,
d. drying the fabric from c,
e. coating the loops on the second side of the cotton pile fabric from d with a formulation containing a second reactive dye and a thickening agent,
f. drying and subsequently curing the fabric from e,
g. washing the cured fabric from f.

4. The method of claim 3 wherein the first reactive dye and second reactive dye are the same.

5. The process of claim 3 comprising the additional step after step g of overdyeing the washed fabric from step g with a third reactive dye.

* * * * *